US005517725A

United States Patent [19]

Mandl et al.

[11] Patent Number: 5,517,725

[45] Date of Patent: May 21, 1996

[54] COMBER MACHINE

[76] Inventors: Gerhard Mandl, Strehlgasse 8, CH-8311 Brütten; Hans-Peter Meile, Pestalozzistrasse 12, CH-8404 Winterthur, both of Switzerland

[21] Appl. No.: 410,892

[22] Filed: Mar. 27, 1995

[51] Int. Cl.[6] ..... D01G 19/16

[52] U.S. Cl. ..... 19/225; 19/115 R; 19/231

[58] Field of Search ..... 19/115, 223, 224, 19/225, 230, 231

[56] References Cited

U.S. PATENT DOCUMENTS

| | | | |
|---|---|---|---|
| 3,320,643 | 5/1967 | Katori | 19/225 |
| 3,479,699 | 11/1969 | Von Kaenel et al. | 19/223 |
| 3,600,758 | 8/1971 | Von Kaenel | 19/225 |
| 3,604,063 | 9/1971 | Von Kaenel | 19/231 |
| 4,079,632 | 3/1978 | Mori et al. | 19/225 X |

FOREIGN PATENT DOCUMENTS

| | | |
|---|---|---|
| 485873 | 3/1970 | Switzerland . |
| 1207441 | 9/1970 | United Kingdom . |

*Primary Examiner*—John J. Calvert
*Attorney, Agent, or Firm*—Martin A. Farber

[57] ABSTRACT

A comber has a nipper head (3), detaching rolls (6), and half-lap (4), wherein, during a combing cycle, the nipper head (3) and the detaching rolls (6) are moved by a drive system (31 to 40) out of a rear end position relative to one another into a front end position and back again. The detaching rolls (6) are driven in a pull-off direction (25) of a combed tuft (11). The half-lap (4) is also driven. The nipper head (3) comes within an area of action of a needle segment (5) of the half-lap (4) during a section of the combing cycle. To increase performance, provision is made for the drive system (31 to 40) to rotate the half-lap (4) during a combing cycle by an integral number of rotations, at least twice. The length of the needle segment (5) is extended in the direction of rotation in accordance with a higher rotational speed.

9 Claims, 3 Drawing Sheets

COMBER MACHINE

FIELD AND BACKGROUND OF THE INVENTION

The present invention relates to a comber having a nipper head with detaching rolls, and having a half lap with a fiber tuft adjacent needles of the half lap.

At a comber during one combing cycle, in other words during a complete forward/backward movement of the nipper, the half-lap with its needles arranged in a segment of a circle accomplishes one complete revolution about its axis. If the comber is operating for example at 300 nips per minute, the half lap will likewise be rotating 300 times a minute and, per rotation, it will comb through the fiber web protruding from the nipper once. In the most inward position, this being the greatest distance of the nipper from the detaching rolls, the needles on the half-lap are at their closest to the nipper. In the most outward position of the nipper, at the shortest distance (detachment length) of the nipper from the detaching roll, the comb cylinder has rotated by about half a rotation, and its needles are positioned on the side turned away from the nipper. To comb the fiber web there is only about one-fifth of the machine cycle available, which means that the sector angle, through which the half-flap carries needles, is determined, and an increase of the combing effect could be achieved only by enlarging the segment radius. Because the comber is required to fulfil certain geometrical conditions in function of the staple length of the fiber material, the radius of the half-lap cannot be enlarged at will, as otherwise these elements would collide.

Persons familiar with the art are aware that only an intimate and multiple contact of the individual fibers with the combing elements lead to a satisfactory combing result, and also that a half-lap carrying needles which gradually become finer will likewise improve the combing result. Accordingly, every effort is to be made to achieve a large surface area for an active half-lap, in order to attain optimum combing quality.

In addition to the performance limitations imposed by the design features referred to above, there is a further disadvantage in that the needle arrangement only passes the brush once per combing cycle, with the result that, at high production rates and in particular with a narrow needle arrangement, the needles cannot be kept sufficiently clean and their effect deteriorates. To avoid this disadvantage, in some cases the machine is periodically switched to a slower speed, which at best incurs loss of production, but more often results in quality fluctuations.

SUMMARY OF THE INVENTION

The invention is accordingly based on the task of increasing the comb effect and to homogenize the combing process.

According to the invention, this task is resolved by constructing a comber having a nipper head with detaching rolls, and having a half lap with a fiber tuft adjacent needles of the half lap; and wherein the half lap is rotated plural times during one cycle.

To the extent that, based on the invention, the revolution speed of the comb cylinder increases during a combing cycle, the cleaning effect on the needles is improved, and hence also the combing effect and homogeneity of the combing process are improved. These effects can be increased still further because the active surface of the needle arrangement can be increased within broad limits.

As a result, the half-lap remains continuously clean and operational machinery stops for half-lap cleaning are unnecessary. This not only results in higher machine performance, but also in uniform and maximum quality of a combing cycle.

BRIEF DESCRIPTION OF THE DRAWINGS

The invention is explained by examples in the schematic drawings appended. These show.

DETAILED DESCRIPTION OF THE PREFERRED EMBODIMENTS

Figure 1:
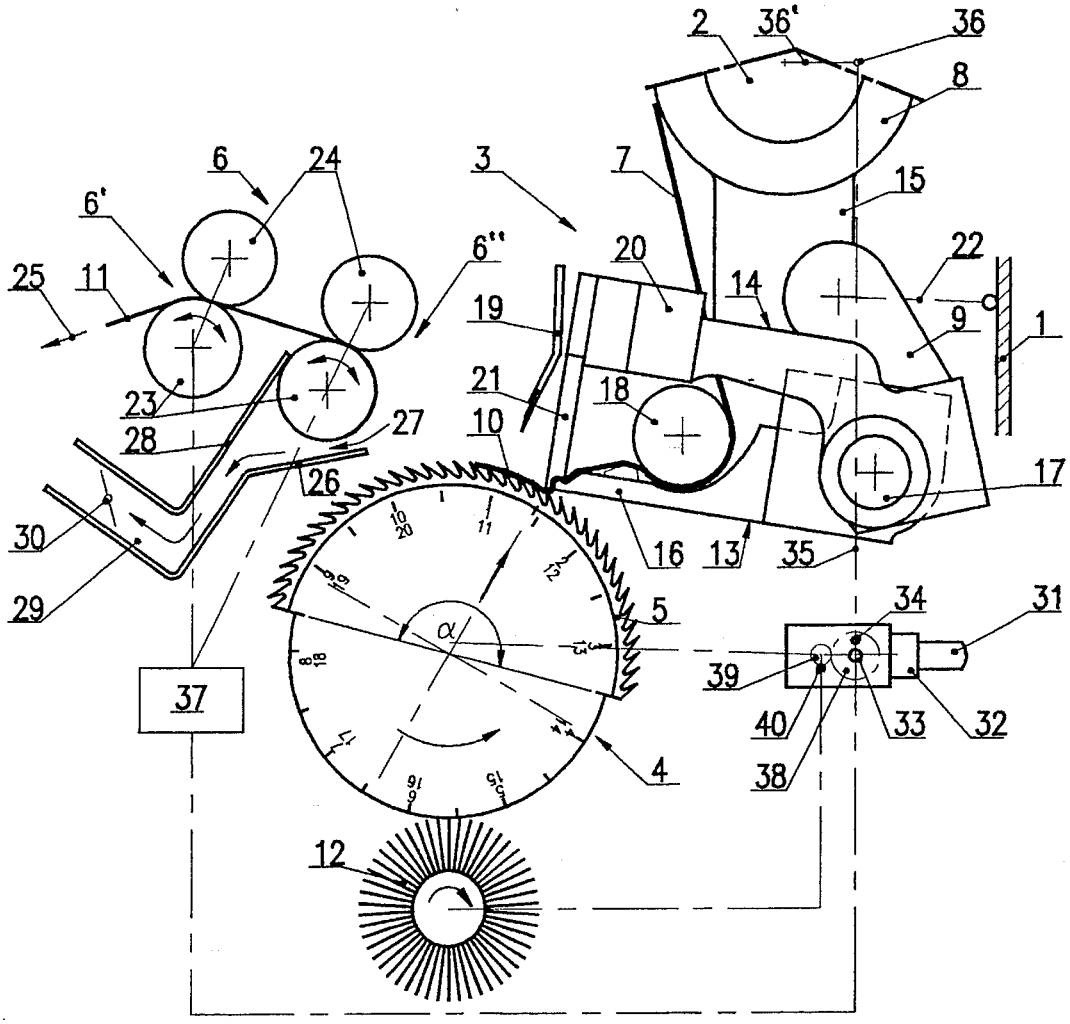
FIG. 1 A cross-section of a comber machine.

FIG. 1 shows the principle layout of a comber machine similar to that described in detail in U.S. Pat. No. 3,479,699 (equivalent to Swiss Patent 485 873). In the machine frame 1, a nipper head 3 with a clamping shackle 8 is secured in a rotatable manner to a nipper shaft 2, operating with a half-lap 4 having a needle-segment 5. The nipper head 3 operates in conjunction with detaching rolls 6. A web 7 which is to be combed is fed continuously to the nipper head 3 from a further lap (not shown) which is located on a continuously driven pair of delivery-rolls, likewise not shown. The leading edge of the web, referred to as a fiber tuft 10, is pieced to the already combed tuft 11, which is held by the detaching rolls 6, the latter moving backward/forward in a step-and-repeat fashion (referred to as pilgrims step). The tuft 10 is passed on and separated from the following web and pieced to the tuft 11. The needle segment 5 is cleaned from the noil combed out of the fiber tuft 10 by means of a brush roller 12, which rotates in the opposite direction at a larger circumferential speed than the half-lap 4. The nipper head 3 features a nipper plate 13, which is coupled to the nipper shaft 2 and a nipper knife 14, which is rotatably mounted.

The nipper plate 13 consists essentially of a nipper plate arm 15 and a nipper plate blade (cushion plate) 16 secured to it. The nipper knife 14 is rotatably mounted on a lateral swivelling journal 17 on the nipper plate arm 15. In addition to this, a feed roller 18 for the web 7 is mounted on bearings on the nipper plate 13, the latter converting the continuous lap feed into a discontinuous feed of the shaft 10. The intermittent drive of the feed roller 18 takes place in the rhythm of the nipper head movement, by means of a pawl drive, not shown here but described in detail in the aforementioned U.S. Pat. No. 3,479,699.

The nipper knife 14 consists essentially of a nipper knife arm 20 linked to the swivel journal 17, and a nipper knife plate 21 (also referred to as the knife blade), secured to the arm 20 as well as a lever 9 secured to this. In addition, the nipper knife 14 is provided with an adjustable penetrating comb 19, which holds back those fibers from the fiber tuft 10 which do not have the length of the tear-off spacing (separation), preventing them from being drawn into the detaching rolls 6.

The nipper knife plate 21 can be swivelled against the nipper plate blade 16 and away from it in the movement rhythm of the nipper head 3, in such a way that the nipper head 3 is closed in the rear end position (as shown in FIG. 1, with the fiber wad 10 clamped tight), or opened in the front end position (in which the knife plate blade 16 has approached the clamping point of the detaching rolls 6 to the distance of the detachment length). The synchronization of the movement of the nipper knife 14 with the movement of the nipper head 3 is effected by means of a linkage 22, the ends of which are attached to the machinery frame 1 on the one hand and, on the other, to the lever 9 which is secured to the nipper knife arm 20.

The detaching rolls 6 comprise two pairs of detaching rolls 6', 6", each of which has a lower, driven detaching roll 23 and an upper roll 24. The detaching rolls can also be formed by only one pair of detaching rollers 6". Their periodic backwards and forwards rotation (as already mentioned) causes the combed tuft 11 to be moved in the direction of the arrow 25 and, in the return movement, causes a connection to be established with the combed fiber tuft 10, fed in from the nipper head. Beneath the lower detaching roll 23 of the pair of rollers 6" is a baffle plate 26, running tangentially to the roll 23 and then parallel at a distance from a second plate 28, which leaves a gap 27 between the two plates 26 and 28 to form a flow channel 29 for an air flow entering through the gap 27. The strength of the air flow entering through the gap 27, can be regulated, for example, by means of a choke device 30 which at high operating speeds, brings the fiber tuft 10 in a controllable manner with the tailing end of the combed tuft 11 in contact on the lower detaching roll 27. This leads to a uniform merger of combed tuft and fiber tuft. In simpler embodiments, the presence of the baffle plate 26 is sufficient to screen the detaching rolls 6 against the air turbulence caused by the half-lap 4 as a result of its increased speed of rotation.

The sector angle $\alpha$ of the needle segment 5 and the radius of the half-lap 4 are dimensioned in such a way that all the needles of the needle segment 5 in the area of the rear final position of the nipper head 3 (as shown in FIG. 1) penetrate through the fiber tuft 10 once. The drive for the comber machine is provided by a motor 31, which drives a timing shaft 33 by means of a reduction gear 32. With each revolution of the timing shaft 33, the machine completes one combing cycle. A crankpin 34, which rotates with the timing shaft 33, is connected in terms of the drive mechanism by a crankshaft 35 with a swivel journal 36 to a lever 36'. The lever 36' is secured to the nipper shaft 2, so that the nipper head 3, during a revolution of the timing shaft 33, is swivelled once out of the rear end position into the front end position and back.

Likewise in cyclical synchronism with the timing shaft 33, the lower detaching rolls 23 are driven by means of a step-and-repeat gear arrangement 37, which is already known, with the result that the movement of the gear arrangement 37 backwards and forwards during a combing cycle takes place in the same manner as with known combers.

In accordance with the invention, the half-lap 4 completes not only one full rotation during one rotation of the timing shaft 33, but two or more. For this purpose, a pinion 38 is located on the timing shaft 33, which engages with a pinion 39, which in turn drives the half-lap 4. The transmission ratio of the timing shaft 33 to the half-lap 4 is 1 :N, where N is a whole number, but at least two. The pinion 39 also drives another pinion 40, with the transmission ratio between these pinions 39, 40 being selected in such a way that the circumferential speed of the brush roller 12 is greater than that of the half-lap 4, the brush roller 12 rotating in the opposite direction to the half-lap 4.

Figure 2:
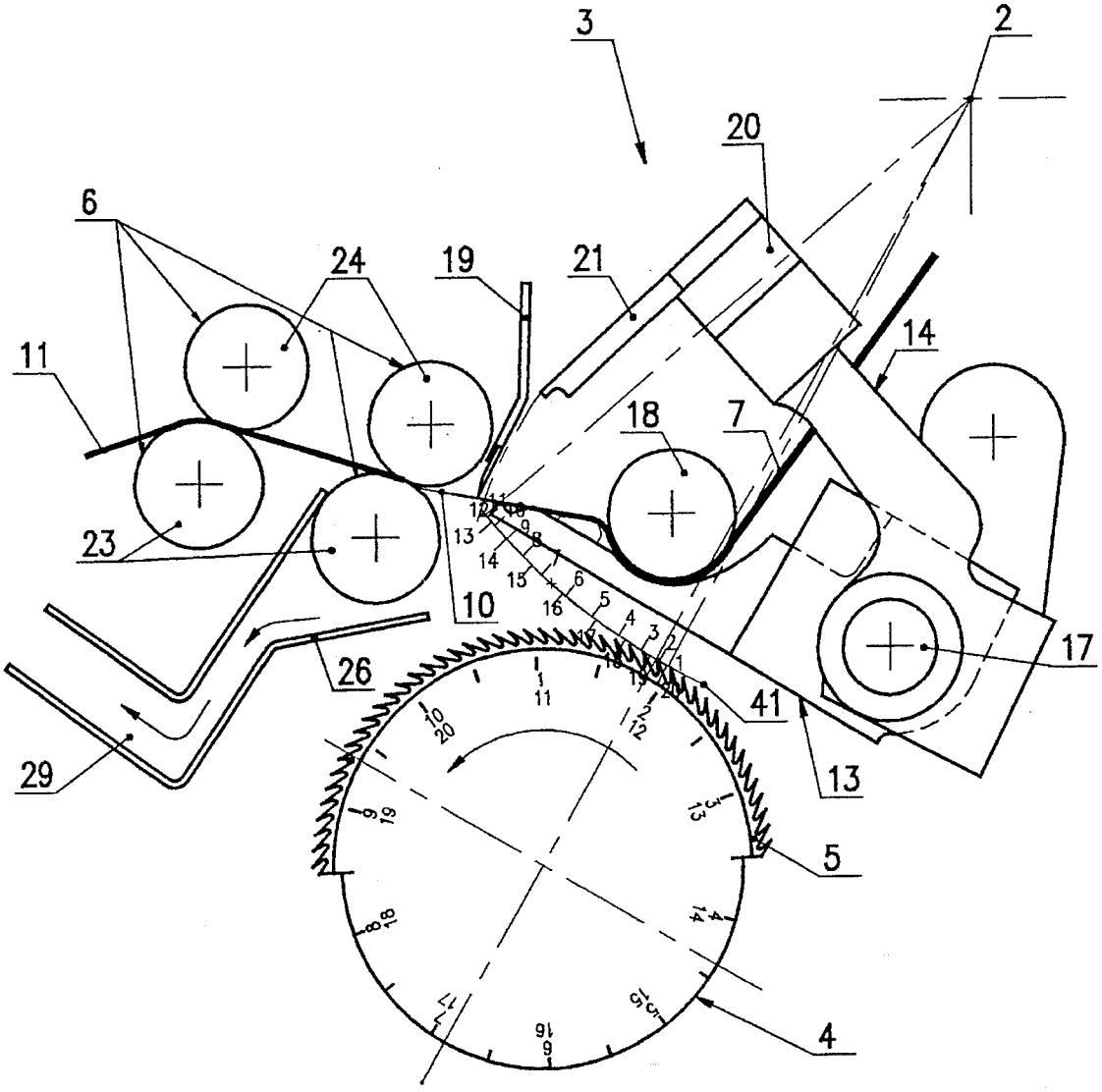
FIG. 2 The same drawing as FIG. 1, showing the movement sequence of the essential elements during a combing cycle, and FIG. 3 A cross-section of a further embodiment of the invention.

In a preferred embodiment of the comber, the half-lap 4 rotates twice during one revolution of the timing shaft 33, in other words during one combing cycle. The mode of operation is described below, based on FIG. 2. To illustrate this more clearly, one machine cycle or one revolution of the timing shaft 33 is subdivided into twenty step increments, designated hereinafter as Index 1 to 20.

During one combing cycle, the nipper head 3 swings around the nipper axis 2, out of the rear end position, via a path which comes very close to the circumferential circle of the half-lap 4, into the front end position, and back. During the swing, the leading edge of the nipper plate 16 moves on an arc 41. During the outward movement (Indices 0 to 12), the nipper head 3 moves away from the half-lap 4, and during the return movement (Indices 12 to 20), the nipper head 3 approaches the half-lap 4 again. During this return movement (Indices 12 to 20) of the nipper head 3, that phase of the combing cycle begins (Index 18½) during which the needle segment 5 engages in the fiber tuft 10, and ends (after the reversal of movement of the nipper head 31) with Index 3½ of the next combing cycle. Because the half-lap 4 carries out two revolutions during one combing cycle, the needle segment 5 again moves beneath the nipper head 3, during a second phase (Index 8½ to 13½) and during which the nipper head 3 adopts a more distant position from the half-lap 4, without a combing process taking place. It is during this period of time that the merging of the fiber tuft 10 with the combed tuft 11 takes place. By doubling the number of rotations of the half-lap 4, the time window delimited by Indices 18½ to 3½ remains unchanged. However, the doubled speed causes the effective length of the needle-segment 5 to be doubled with a given comb cylinder diameter. The increase and homogenization of the combing effect, which the invention seeks to achieve, is attained. The limits of this time window are essentially fixed. As a result, the active circumferential length of the needle segment 5, obtained with a whole-number multiplication of the rotational speed of the half-lap 4 (and with the radius remaining the same), can be increased in the same proportion without the half-lap 4 colliding with the nipper head 3, the detaching rolls 23, or the baffle plate 26.

The half-lap 4, rotating at greater speed, produces air turbulence in the area of the detaching rolls 6, which might impede a the trouble-free merging of the fiber tuft 10 with the combed top end 11. To control such turbulence, if necessary, the choke 30 is used to change the air flow in the gap 27 until the fiber tuft and the end of the combed top meet one another at a precisely defined position.

The invention allows for the following advantages to be obtained: It is possible to comb out heavy wads. The fiber tuft is combed through during a combing cycle by approximately double the number of comb elements. More short fibers, impurities, and neps are separated out. The needle segment remains clean, because it is cleaned by the brush roller at least twice per combing cycle. In addition to this, because of the longer needle segment, the first row of needles can be arranged less densely, without inhibiting the combing effect. As a result, no air pressure wave is incurred in front of the needle segment with the half-lap running. Such a wave would push the fiber tuft away and raise it above the needle segment, would impair the combing effect of the needle segment, and might render the combing effect impossible.

Alternatively, the nipper head 3 can be displaced backwards and forwards, between its front and rear end positions, instead of on a bow-shaped path, on another curve-shaped or straight track.

Figure 3:
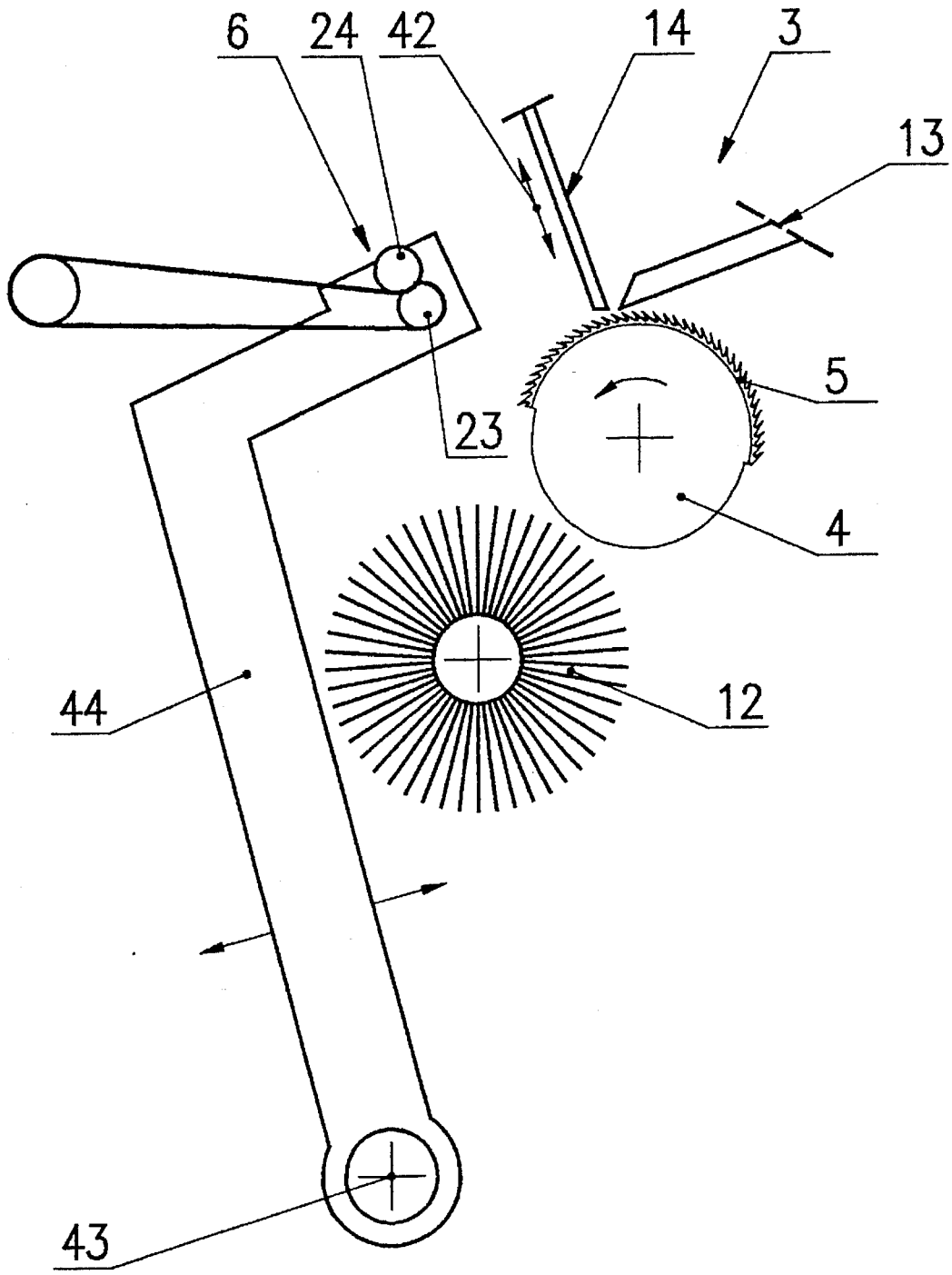

Further, as FIG. 3 shows, the invention can also be applied on comber machines as described, for example, in GB-Patent 1 207 441. With these comber machines, the nipper head 3 can only be moved up and down during a combing cycle in the direction of the double arrow 42. The relative movement between the nipper head 3 and the detaching roll 6 is dependent exclusively on the detaching rolls 6, which for this purpose are mounted on bearings on an oscillating link 44, capable of a swivelling movement about an axis 43. The link 44 is moved once during a combing cycle out of its rear end position into the front end position and back again, moved by means of a drive unit which is not shown, as indicated by the two arrows.

We claim:

1. A comber machine comprising a nipper head, detaching rolls, and a half-lap having a needle segment;

a drive system means for providing, during one combing cycle, movement of the nipper head and the detaching rolls from a rear end position relative to one another to a front end position and back again;

wherein during the movement, the detaching rolls are driven in pilgrim step in a combed tuft draw of direction; and the half lap rotates of the combed tuft in the draw-off direction of the combed tuft;

wherein the nipper head holds a fiber tuft in an area of effect of the needle segment of the half-lap during one section of a combing cycle; and the drive system means rotates the half-lap plural times during one combing cycle.

2. A comber machine according to claim 1, wherein the drive system means rotates the half-lap during one combing cycle an integral number of times greater than or equal to two.

3. A comber machine according to claim 1, wherein a length of the needle segment extends in the direction of rotation at least partially in an amount proportional to the number of rotations.

4. A comber machine according to claim 1, wherein the nipper head is movable in a combing cycle out of the rear end position against the detaching rolls into the front end position and back again through the rear end position.

5. A comber machine according to claim 1, wherein the nipper head is movable on a straight or curved path.

6. A comber machine according to claim 1, wherein the detaching rolls are movable during a combing cycle out of the rear end position against the nipper head through the front end position and back again.

7. A comber machine according to claim 1, wherein the drive system brings the half-lap into the area of effect of the needle segment during the one section of the combing cycle;

the detaching rolls include an upper and a lower roll; and a baffle plate is located between the half-lap and the lower detaching roll located closest to the plate in an axially parallel position.

8. A comber machine according to claim 7, wherein the baffle plate forms a gap with the lower detaching roll; and the comber machine further comprises air flow means to create a controllable air flow in the gap.

9. A comber machine according to claim 7, wherein said baffle plate is a first baffle plate, and the comber machine further comprises a second baffle place forming a flow channel in conjunction with the first baffle plate.

* * * * *